US007287904B2

(12) United States Patent
Withers

(10) Patent No.: US 7,287,904 B2
(45) Date of Patent: Oct. 30, 2007

(54) BAG WITH CRIMPED PORTION TO RETAIN SLIDER

(75) Inventor: Philip Craig Withers, Southbank (AU)

(73) Assignee: International Consolidated Business Pty Ltd., Melbourne (AU)

( * ) Notice: Subject to any disclaimer, the term of this patent is extended or adjusted under 35 U.S.C. 154(b) by 357 days.

(21) Appl. No.: 10/508,565

(22) PCT Filed: Mar. 21, 2003

(86) PCT No.: PCT/AU03/00344

§ 371 (c)(1),
(2), (4) Date: Apr. 28, 2005

(87) PCT Pub. No.: WO03/080457

PCT Pub. Date: Oct. 2, 2003

(65) Prior Publication Data

US 2005/0220372 A1 Oct. 6, 2005

(30) Foreign Application Priority Data

Mar. 22, 2002 (AU) ..... PS1302

(51) Int. Cl.
*B65D 33/16* (2006.01)
*A44B 1/04* (2006.01)

(52) U.S. Cl. ..... 383/64; 24/399; 24/400

(58) Field of Classification Search ..... 383/64; 24/399–400

See application file for complete search history.

(56) References Cited

U.S. PATENT DOCUMENTS 5,189,764 A 3/1993 Herrington et al.
5,301,395 A 4/1994 Richardson et al.
6,161,271 A * 12/2000 Schreiter ..... 29/408

(Continued)

FOREIGN PATENT DOCUMENTS

WO WO98/29004 7/1998

(Continued)

*Primary Examiner*—Nathan J. Newhouse
*Assistant Examiner*—Avery Prioleau
(74) *Attorney, Agent, or Firm*—Stites & Harbison PLLC; Douglas E. Jackson

(57) ABSTRACT

A reclosable plastic bag (10) having two panels (15) of plastics sheet or film joined to, or integral with, each other, or a combination of both, to define a bag with an opening (13), with separable fastening means (14) of one or more interengagable elongate fib/groove configurations (14*a*, 14*b*) are provided to close the opening (13). A slider (100) is positioned in straddling relationship to the fastening means, and includes a support member (111) over-lying the opening to the bag and straddling the fastening means, and also carrying a separating finger (112) to engage with and separate the fastening means when the slider is moved to a first end of the fastening means in a bag opened condition, and a pair of legs (113) extending from said support member to force the fastening means into interengaging relationship when the slider is moved to a second end of said fastening means in a bag closed condition. Flanges (119) on the legs extend beneath the fastening means to retain the slider on the bag. The edges (19) of the panels of the bag adjacent the second end of the fastening means are bonded together with a portion thereof between the bonding and said fastening means being crimped to define a torturous path (20*a*) between the panels into which path the separating finger (112) the slider is received to be gripped by the portions of the panels on either side of the torturous path to thereby retain the slider in the bag closed condition.

5 Claims, 2 Drawing Sheets

U.S. PATENT DOCUMENTS

| | | | | |
|---|---|---|---|---|
| 6,442,804 | B2 * | 9/2002 | Turvey et al. | 24/399 |
| 2003/0228076 | A1 * | 12/2003 | Plourde et al. | 383/64 |

FOREIGN PATENT DOCUMENTS

| | | |
|---|---|---|
| WO | WO 00/76340 | 12/2000 |
| WO | WO 00/76352 | 12/2000 |
| WO | WO 01/14213 | 3/2001 |
| WO | WO 02/19861 | 3/2002 |

* cited by examiner

BAG WITH CRIMPED PORTION TO RETAIN SLIDER

TECHNICAL FIELD

This invention relates to improvements in reclosable plastic bags and slider assemblies, that is, plastic bags which can be repeatedly opened and closed to receive and retrieve contents, and sometimes known as "zipper bags", whilst a plastic slider is used for opening and closing such reclosable plastic bags. Such bags are formed from a pair of flexible plastic sheets or panels having top edges with separable fastening means extending along the lengths of the top edges and therefore at the opening of the bag with the slider straddling the separable fastening means.

BACKGROUND ART

Such bags conventionally are of rectangular configuration formed from an elongate plastic sheet or film folded upon itself to form two panels and sealed together along their opposite side edges with an opening defined by the free edges of the panels. The opening is adapted to be repeatedly opened and closed by fastening means formed from a rib extending across one of the panels below the opening of the bag and interengaging in a groove formed between, and therefore defined by, two ribs extending across the other panel and also below the opening of the bag. Two parallel extending ribs on either sides of the rib which engages within the groove serve to capture the ribs within the defined groove.

The ribs and grooves are shaped and dimensioned so that the rib fits tightly within its associated groove and the ribs defining the associated groove deform to allow the rib to enter and to be captured within its associated groove.

The sliders conventionally have a separator finger carried by a complimentary structure which has a transverse finger support member from which legs depend and with lower inwardly directed flanges which engage beneath the separable fastener means to hold the slider on the bag and around the fastener. The finger serves to separate the fastener as the slider is moved in one direction along the separable fastener means, whilst the legs of the slider press the rib and groove of the fastener means together to close the fastener when the slider is moved in the opposite direction.

However, such bag/slider assemblies are subject to difficulties with holding the slider in position when moved to its bag closed position, and it is an object of the present invention to minimise, if not eliminate, this difficulty.

DISCLOSURE OF THE INVENTION

In accordance with the present invention there is envisaged a reclosable plastic bag having at least two panels of plastics sheet or film joined to, or integral with, each other, or a combination of both, to define a bag with an opening, separable fastening means of one or more interengagable elongate rib/groove configurations to close said opening, a slider positioned in straddling relationship to said fastening means, said slider including a support member overlying the opening to the bag and straddling said fastening means, and also carrying a separating finger to engage with and separate said fastening means when said slider is moved to a first end of said fastening means in a bag opened condition, and a pair or legs extending from said support member to force said fastening means into interengaging relationship when the said slider is moved to a second end of said fastening means in a bag closed condition, means on said legs and extending beneath said fastening means to retain said slider on said bag, and wherein the edges of said panels of said bag adjacent said second end of fastening means are bonded together with a portion thereof between said bonding and said fastening means being crimped to define a torturous path between said panels into which path part of the slider is received to be gripped by the portions of said panels on either side of said torturous path to thereby retain said slider in the bag closed condition.

Preferably at least one elongate strengthening rib is provided adjacent, and parallel, to said fastening means and on one or each of the panels of the bag inwardly from said fastening means.

Preferably the, or each, elongate strengthening rib cooperates with said slider retaining means extending beneath said fastening means to align the slider with said fastening means.

Preferably the, or each, said elongate strengthening rib and said slider retaining means are configured to produce an audible sound and/or tactile feel as said slider is moved along said bag opening.

Preferably the part of said slider which is received within the torturous path is said separating finger.

BRIEF DESCRIPTION OF THE DRAWINGS

One preferred embodiment of the invention will now be described with reference to the accompanying drawings, in which.

BEST MODE FOR CARRYING OUT THE INVENTION

Figure 1:
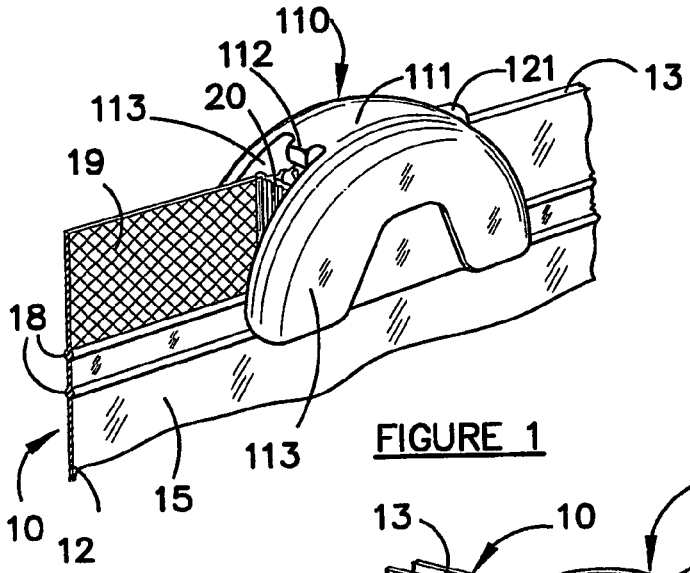
FIG. 1 is a perspective view of the slider/bag assembly in the bag closed condition.
Figure 2:
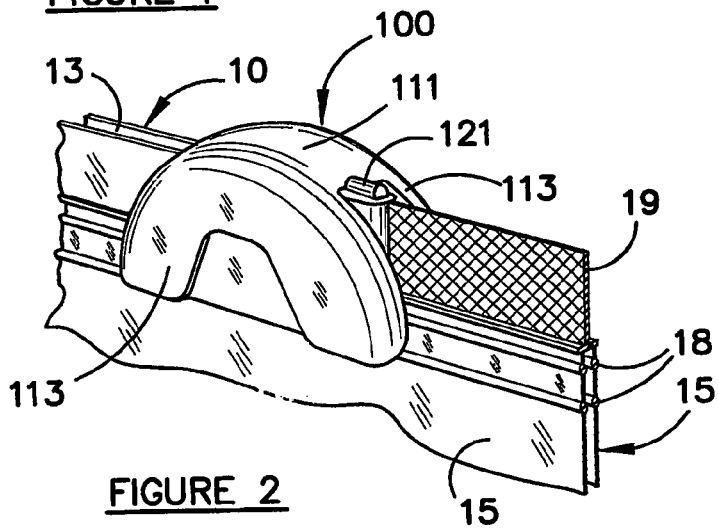
FIG. 2 is a perspective view of the slider/bag assembly in the bag opened condition.
Figure 3:
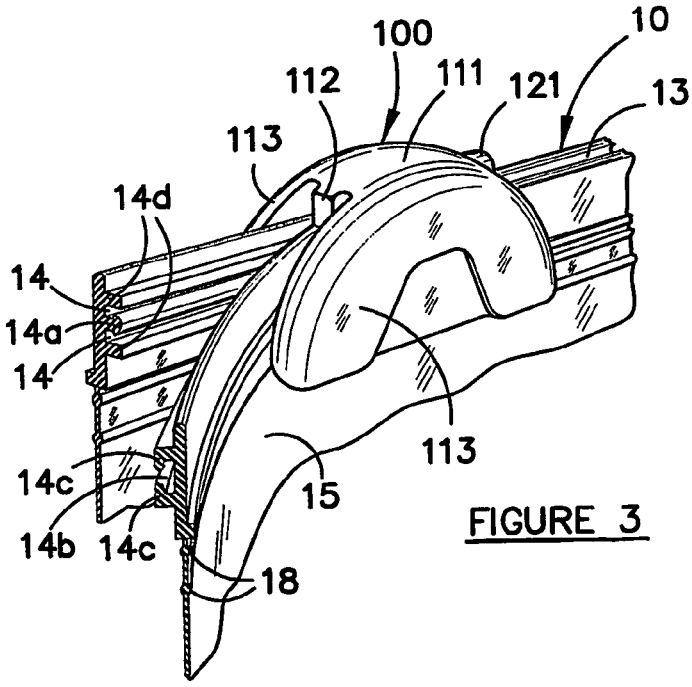
FIG. 3 is a perspective view of the slider/bag assembly during the process of moving to or from the bag closed condition.
Figure 4:
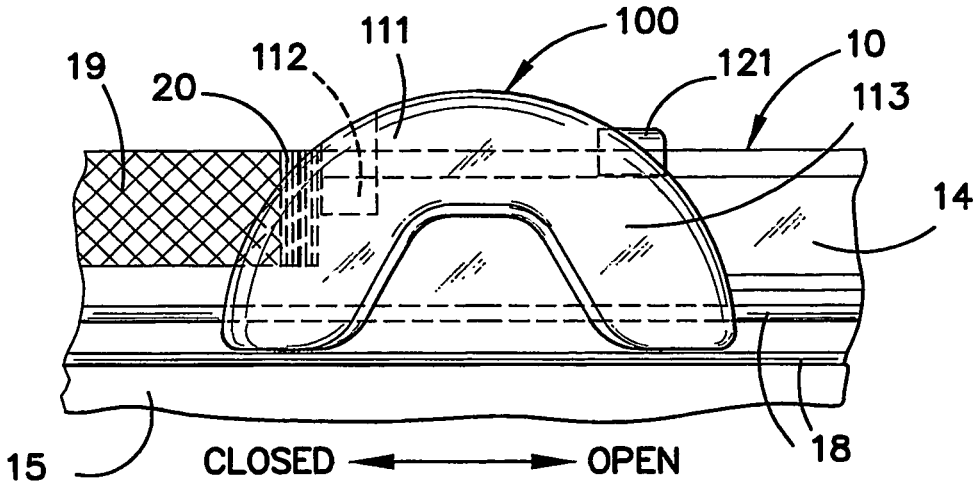
FIG. 4 is a side view of the slider/bag assembly of FIGS. 1 to 3.
Figure 5:
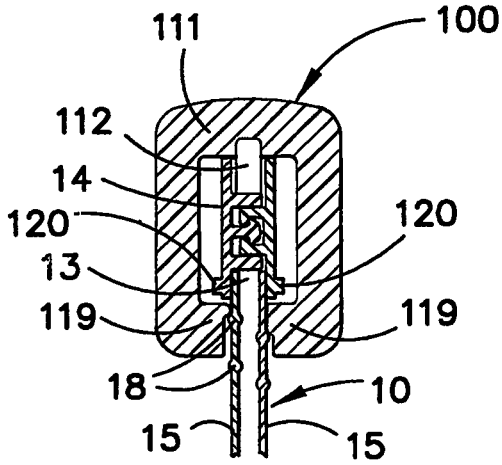
FIG. 5 is a transverse cross-sectional view of the assembly of FIG. 4.
Figure 6:
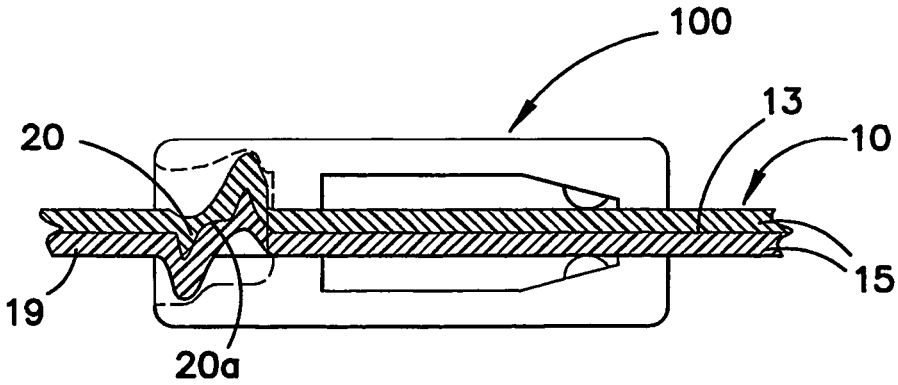
FIG. 6 is a view from beneath of the assembly of FIGS. 4 and 5.

In this preferred embodiment, the reclosable plastic bag after assembly, is generally indicated as 10. The plastic bag is formed from an extruded tube of plastic sheet or film which when flattened produces a fold line 11 which will define the bottom of the bag, and which therefore produces a pair of panels 15 which are thereafter sealed along their opposite side edges 12 to provide a plastic bag having an opening 13 at the top of the bag when the other side of the tube is slit. The opening 13 is adapted to be repeatedly opened and closed by an extruded fastening means 14, and consisting of a rib 14*a* extending across the width of one panel at the opening of the bag and below the opening of the bag, and also engaging and captured within a groove 14*b* defined by a pair of ribs 14*c* extending across the width of the other panel of the bag at its opening. A pair of ribs on either side of the rib 14*a*, which engages within the groove 14*b*, serves to also capture the ribs 14*c* which define the grooves.

A plurality, in this preferred embodiment two, parallel strengthening ribs 18 are also extruded beneath the fastening means 14, to in effect bear some of the forces applied to the fastening 14 and thus minimise the possibility of splitting or breaking of the bag inwardly of the fastening means, whilst at the same time strengthening the panels of the bag adjacent the fastening means to provide additional rigidity to assist in aligning the interengaging rib/groove configuration when closing the bag.

The fastening means 14, and the strengthening ribs 18, are all extruded when the tube from which the bag will be formed is extruded and before the tube is slit.

The strengthening ribs 18 may be formed by altering the profile of the extrusion die, or by injecting plastics material directly onto the surface of the tube as it is being extruded, or by a forming process through a grooved die head also when the tube for the bag is being extruded. A more manufacturing and material costly laminating process could also be used if necessary. In the case of laminated profiles, multi-layers could be laminated which makes the bag more suitable for freezer and cold storage applications.

Both ends of the upper edges of the panels are bonded together at 19 such as by heat and pressure welding, whilst in accordance with the invention a portion 20 of the upper edge of the panels between the bonded portion 19 at the bag closed end of the fastening means, and the adjacent end of the fastening means, is configured by crimping to define a torturous path 20*a* between the edges of the panels over the length of the portion 20 and adapted to receive and retain the separating finger 112 of the slider 100 (to be later described) in the bag closed condition. The portion 20 and the adjacent bonded portion 19 also serve to prevent the slider moving off the end of the opening of the bag without the need for raised end portions or cut-outs that have had to be used with some known assemblies.

The slider of this preferred embodiment is moulded as a one piece plastic component. Alternatively the slider could be made from a plurality of separate parts which are clipped together.

The slider, generally indicated as 100, of this preferred embodiment of the invention includes a support member 111 to the underside of which is moulded the separating finger 112, and may be of any number of types of configurations, and which would normally be moulded with the remainder of the slider. The support member on opposite side edges thereof has depending legs or panels 113 extending along the opposite longitudinal sides respectively. A multiplicity of ribs (not shown) may be formed on the outsides of the panels 13 to assist in finger gripping during movement of the slider during opening and closing the fastener means of the plastic bag.

An end stop 121 formed on the support member 111 engages the bonded end 19 at the bag open position of the slider to prevent the slider from moving off that end of the bag opening, once again without the need for raised end portions or cut-outs that have had to be used with some known assemblies. The lower ends of the panels towards one end thereof carry flanges 119 which engage beneath ledges 120 formed beneath the fastening means 14 of the plastic bag, whilst the cooperation of flanges 119 of the slider with the strengthening ribs 18 of the bag serves to align the slider with the fastening means.

In addition the, or each, strengthening rib 18 and the flanges 119 may be configured, such as by spaced apart ribs along one interengaging with spaced apart grooves on the other, and such that when the flanges 119 are moved relative to the strengthening ribs 18 an audible sound and/or tactile feel is produced as the slider is moved along the bag opening.

The claims defining the invention are as follows:

1. A reclosable plastic bag having at least two panels of plastics sheet or film joined to, or integral with, each other, or a combination of both, to define a bag with an opening, separable fastening means of one or more interengagable elongate rib/groove configurations to close said opening, a slider positioned in straddling relationship to said fastening means, said slider including a support member overlying the opening to the bag and straddling said fastening means, and also carrying a separating finger to engage with and separate said fastening means when said slider is moved to a first end of said fastening means in a bag opened condition, and a pair or legs extending from said support member to force said fastening means into interengaging relationship when the said slider is moved to a second end of said fastening means in a bag closed condition, means on said legs and extending beneath said fastening means to retain said slider on said bag, and wherein edges of said panels of said bag adjacent said second end of fastening means are bonded together with a portion thereof between said bonding and said fastening means being crimped to define a torturous path defined by transversely directed projections between said panels into which path part of the slider is received to be gripped by said projections of said panels on either side of said torturous path to thereby retain said slider in the bag closed condition.

2. A reclosable plastic bag as claimed in claim 1, wherein at least one elongate strengthening rib is provided adjacent, and parallel, to said fastening means and on one or each of the panels of the bag inwardly from said fastening means.

3. A reclosable plastic bag as claimed in claim 2, wherein the, or each, elongate strengthening rib cooperates with said slider retaining means extending beneath said fastening means to align the slider with said fastening means.

4. A reclosable plastic bag as claimed in claim 1, wherein the, or each, said elongate strengthening rib and said slider retaining means are configured to produce an audible sound and/or tactile feel as said slider is moved along said bag opening.

5. A reclosable plastic bag as claimed in claim 1, wherein the part of said slider which is received within the torturous path is said separating finger.

* * * * *